US011696669B2

(12) United States Patent
Held et al.

(10) Patent No.: US 11,696,669 B2
(45) Date of Patent: Jul. 11, 2023

(54) HOLDER, ARRANGEMENT AND DOMESTIC DISHWASHER

(71) Applicant: BSH Hausgeräte GmbH, Munich (DE)

(72) Inventors: Martin Held, Niederstotzingen (DE); Martin Siddiqui-Baeumert, Kronberg (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 17/629,427

(22) PCT Filed: Jul. 15, 2020

(86) PCT No.: PCT/EP2020/069964
§ 371 (c)(1),
(2) Date: Jan. 24, 2022

(87) PCT Pub. No.: WO2021/018584
PCT Pub. Date: Feb. 4, 2021

(65) Prior Publication Data

US 2022/0240749 A1 Aug. 4, 2022

(30) Foreign Application Priority Data

Jul. 26, 2019 (DE) ..... 10 2019 211 128.9

(51) Int. Cl.
*A47L 15/50* (2006.01)

(52) U.S. Cl.
CPC ..... *A47L 15/503* (2013.01); *A47L 15/505* (2013.01)

(58) Field of Classification Search
CPC ..... A47L 15/50; A47L 15/503; A47L 15/505; A47L 19/04
(Continued)

(56) References Cited

U.S. PATENT DOCUMENTS 5,249,590 A * 10/1993 Jacobus ..... A47L 15/505 134/201
5,918,749 A * 7/1999 Pille ..... A47L 15/505 211/41.9
(Continued)

FOREIGN PATENT DOCUMENTS

CN 107440664 A 12/2017
DE 102016212504 A1 * 1/2018 ..... A47L 15/503
(Continued)

OTHER PUBLICATIONS

National Search Report DE 102019211128.9 dated Jun. 26, 2020.
International Search Report PCT/EP2020/069964 dated Sep. 25, 2020.

*Primary Examiner* — Patrick D Hawn
(74) *Attorney, Agent, or Firm* — Michael E. Tschupp; Andrew Pallapies; Brandon G. Braun

(57) ABSTRACT

A holder for holding washware in a dish rack of a household dishwasher includes a holding element fastenable on a side wall of the dish rack for pivoting about a vertical axis in a first pivoting direction and a second pivoting direction in opposition to the first pivoting direction. The holding element is designed to block the holding element from pivoting in the first pivoting direction and in the second pivoting direction when the holding element assumes a holding position in which the washware is held and the holding element is pivoted away from the side wall in the holding position.

14 Claims, 6 Drawing Sheets

(58) Field of Classification Search
USPC ..... 211/41.1–41.9
See application file for complete search history.

(56) References Cited

U.S. PATENT DOCUMENTS 6,123,204 A * 9/2000 Nelson ..... A47L 15/505 211/41.9
6,189,847 B1 * 2/2001 Hart ..... B25H 3/04 248/220.31
6,394,285 B1 5/2002 Arthurs
D518,936 S * 4/2006 Yang ..... D32/55
7,458,471 B2 * 12/2008 Crudgington, Jr. ... A47L 15/505 211/41.9
7,594,637 B2 * 9/2009 Krueger ..... B60N 3/101 248/113
7,644,826 B2 * 1/2010 Koch ..... A47L 15/503 211/41.4
7,984,812 B2 * 7/2011 Pike ..... A47L 15/503 211/41.9
7,988,107 B2 * 8/2011 Miller ..... A47L 15/505 211/41.9
8,418,703 B2 * 4/2013 Schessl ..... A47L 15/505 134/201
8,701,898 B2 * 4/2014 Chai ..... A47L 15/503 211/41.6
8,714,371 B2 * 5/2014 Haider ..... A47L 15/503 211/41.4
8,789,711 B2 * 7/2014 Haltmayer ..... A47L 15/503 211/41.9
9,615,722 B2 * 4/2017 Mesa ..... A47L 15/50
10,405,731 B2 * 9/2019 Harr ..... A47L 15/503
11,006,814 B1 * 5/2021 Simmonds ..... A47L 15/503
11,419,479 B2 * 8/2022 Kim ..... A47L 15/503
2005/0242046 A1 * 11/2005 Lee ..... A47L 15/503 211/41.9
2007/0039904 A1 * 2/2007 Purushothaman .... A47L 15/503 211/41.8

FOREIGN PATENT DOCUMENTS

EP 3045099 A2 7/2016
IT TO20110740 A1 2/2013
JP H0332630 A 2/1991
WO 2012089464 A1 7/2012

* cited by examiner

HOLDER, ARRANGEMENT AND DOMESTIC DISHWASHER

CROSS-REFERENCES TO RELATED APPLICATIONS

This application is the U.S. National Stage of International Application No. PCT/EP2020/069964, filed Jul. 15, 2020, which designated the United States and has been published as International Publication No. WO 2021/018584 Al and which claims the priority of German Patent Application, Serial No. 10 2019 211 128.9, filed Jul. 26, 2019, pursuant to 35 U.S.C. 119(a)-(d).

The contents of International Application No. PCT/EP2020/069964 and German Patent Application, Serial No. 10 2019 211 128.9 are incorporated herein by reference in their entireties as if fully set forth herein.

BACKGROUND OF THE INVENTION

The present invention relates to a holder for holding washware in a dish rack. The present invention further relates to an arrangement for a household dishwasher. The present invention also relates to a household dishwasher having such a holder or such an arrangement.

A dishwasher has a dishwasher cavity and at least one dish rack which may be displaced into the dishwasher cavity and out of said dishwasher cavity. The dishwasher may have a plurality of dish racks arranged one above the other, such as for example a bottom rack, a top rack and a cutlery drawer. Baking sheet holders which are pivotably connectable to a vertical wire of the dish rack are also known.

BRIEF SUMMARY OF THE INVENTION

In view of this background, it is an object of the present invention to provide an improved holder for a dish rack.

Accordingly, a holder for holding washware in a dish rack of a household dishwasher is proposed. The holder comprises a holding element which can be fastened on a side wall of the dish rack such that it can be pivoted about a vertical axis in a first pivoting direction and a second, opposing pivoting direction and which is designed so that, in a holding position for holding the washware, it blocks pivoting in the first pivoting direction and in the second pivoting direction, wherein, in the holding position, the holding element has been pivoted away from the side wall.

Thus washware may be leant against the holder or the holding element and securely supported from all sides. Advantageously, therefore, the dish rack is able to be used in a versatile manner. The holder is preferably a baking sheet holder. "Pivoting" means a rotational movement about an axis of rotation. The first pivoting direction and the second pivoting direction in this case refer to the same axis of rotation. In this case, the axis of rotation is preferably a vertical axis. "Pivotably fastenable" means, for example, a hinge-like fastening.

"Holding position" means a position in which the holding element is designed to hold, in particular support, washware. "Washware" comprises, in particular, a plate, a vessel, a food container or a baking sheet. In the holding position, the holding element preferably protrudes into a receiving volume of the dish rack. In particular, the holding element protrudes perpendicularly away from the side wall. "Blocking" means that no movement is possible in the first pivoting direction and in the second pivoting direction. The holding element preferably has at least one further position. The holder may be, in particular, a baking sheet holder.

According to one embodiment, the holder comprises a fastening element which is rigidly fastenable to the side wall of the dish rack, wherein the holding element is pivotably fastened to the fastening element.

"Rigidly fastenable" means in this case that the fastening element does not have degrees of freedom of movement relative to the side wall of the dish rack. Preferably, the holding element and the fastening element are connected together in a hinge-like manner. As a result, well-defined motion kinematics may be advantageously provided between the holding element and the fastening element.

According to a further embodiment, the blocking of the pivoting in the holding position is carried out by means of a positive connection between the fastening element and the holding element.

This has the advantage that a reliable blocking may be implemented and thus a high degree of force may be supported. Preferably, the fastening element engages in the holding element in some regions, or vice versa, in order to bring about the positive connection.

According to one embodiment, the holding element comprises a recess and the fastening element comprises a lug, wherein the recess is able to be pushed onto the lug in order to bring about the positive connection.

"Lug" means in the present case a projection. Preferably, the lug extends upwardly in the vertical direction. In particular, the fastening element comprises two identical and adjacent lugs. Preferably, the recess is U-shaped. The lug or lugs and the recess preferably form a clearance fit in the holding position.

According to a further embodiment, in the holding position the holding element is movable upwardly in the vertical direction relative to the fastening element in order to release the positive connection.

Thus a releasable positive connection is provided. In the holding position a movement of the holding element downwardly is blocked. After the holding element has been moved upwardly, this holding element may be moved downwardly again in order to reach the holding position. The fastening element in this case comprises insertion bevels which bring about a centering of the holding element when this holding element is moved downwardly. As a result, the recess may be advantageously pushed onto the lug in order to bring about the positive connection.

According to a further embodiment, the fastening element comprises a sleeve portion in which the holding element engages in some regions and in which the holding element is guided.

Advantageously, the holding element is guided in a linear manner by means of the sleeve portion. Preferably, the sleeve portion comprises a gap through which a vertical wire may be guided. For example, the sleeve portion is able to be resiliently bent open and thereby pushed onto the vertical wire in order to enclose this vertical wire in a positive manner. In this case, for example, a latching connection may be formed.

According to a further embodiment, the holding element comprises a fastening means which is pivotably fastenable to a vertical wire of the dish rack and which is designed to enclose the vertical wire.

Preferably, the fastening means is configured as a sleeve part. In particular, the fastening means has an annular shape or C-shape which is open in cross section. The fastening means is guided in the sleeve portion or on the vertical wire and thus forms a linear bearing with this or with these.

Preferably, a movement of the fastening means upwardly in the vertical direction is defined by a stop of the fastening element. In particular, the fastening element and the fastening means form a latching connection.

According to a further embodiment, the fastening element comprises a receiver for the fastening means of the holding element. Preferably, the fastening means is able to slide upwardly in the receiver in the vertical direction.

According to a further embodiment, the fastening element comprises a fastening part which is fastenable to a horizontal wire of the side wall.

Advantageously, the fastening element may be fixed thereby in the vertical direction. Preferably, the fastening part comprises a latching lug which is designed to be latched to the horizontal wire. Thus a releasable latching connection is formed. In particular, the fastening part comprises two latching lugs arranged adjacent to one another.

According to a further embodiment, in a first folded-in position in which the holding element bears against the side wall, the holding element is designed to block pivoting in the first pivoting direction and in the second pivoting direction.

A second position, in which the holding element is fixed, may be advantageously provided thereby. In particular, the holding element is arranged higher in the folded-in position than in the holding position. The folded-in position has the advantage that the holding element may be folded in if it is not required. Thus the receiving volume of the dish rack is not reduced by the holding element. "Bearing against" means, for example, that the holding element is oriented parallel with the side wall.

Preferably, the first folded-in position is a first latching position between the holding element and the fastening element. In particular, the fastening element and the holding element are provided such that when a horizontal force threshold is exceeded (in the direction of the second pivoting direction) the holding element moves out of the first folded-in position in the second pivoting direction. Preferably, the sleeve portion comprises a lug which in this case is pushed upwardly and releases the pivoting movement in the second pivoting direction. In the first folded-in position, a further pivoting in the first pivoting direction is preferably not possible due to a stop. A vertical movement of the holding element upwardly and/or downwardly from the first folded-in position is preferably not possible due to a positive connection.

According to a further embodiment, in the first folded-in position the holding element forms a positive connection with the fastening element.

Preferably, the positive connection is releasable. In particular, the positive connection is formed by a latching connection. Preferably, a connecting portion of the holding element is located in a recess of the sleeve portion, wherein the lug of the sleeve portion engages behind the connecting portion.

According to a further embodiment, in a second folded-in position in which the holding element rotated by 180° to the first folded-in position bears against the side wall, the holding element is designed to block pivoting in the first pivoting direction and in the second pivoting direction.

Preferably, the second folded-in position is a second latching position between the holding element and the fastening element. The second folded-in position in this case may be denoted as the opposing position. In order to implement the second folded-in position, the sleeve portion may comprise a second recess which is provided mirror-symmetrically to the first recess. Moreover, a second lug may be provided on the sleeve portion in order to form a further latching connection.

An arrangement for a household dishwasher having a dish rack and a holder, which is fastened to a side wall of the dish rack as described above, is also proposed.

Preferably, the dish rack comprises a front wall, a rear wall provided opposite the front wall, two opposing side walls and a bottom (rack bottom). The dish rack is preferably configured as a rack structure which is formed, in particular, by means of wires. The rack bottom is, for example, a wire mat. In particular, the rack structure comprises a loading opening through which washware, in particular plates, vessels and baking sheets, may be inserted into the rack structure for washing the washware.

According to one embodiment, the dish rack comprises a first side wall and an opposing second side wall, wherein a first holder is pivotably fastened to the first side wall and a second holder is pivotably fastened to the second side wall, and wherein the first and the second holders are designed to hold a baking sheet in the holding positions thereof.

If the first and the second holders are located in holding positions, the support portions thereof are preferably in one plane. Preferably, the first holder and the second holder are configured identically.

According to a further embodiment, a third holder is pivotably fastened to the first side wall and a fourth holder is pivotably fastened to the second side wall, wherein the third and the fourth holders are designed to hold the baking sheet in the holding positions thereof.

Preferably, the support portions of the third holder and the fourth holder are in one plane when they are located in the holding positions thereof.

In particular, the holder is between 2 and 15 cm, 3 and 10 cm or 4 and 8 cm long when it is located in the holding position.

Moreover, a household dishwasher having a holder as described above and/or an arrangement as described above is proposed.

The embodiments and features described in connection with the holder accordingly apply to the arrangement and the household dishwasher.

Further possible implementations of the invention also comprise combinations, which are not explicitly mentioned, of features or embodiments described above or below relative to the exemplary embodiments. In this case, the person skilled in the art will add individual aspects as improvements or additions to the respective basic form of the invention.

Further advantageous embodiments and aspects of the invention form the subject matter of the subclaims as well as the exemplary embodiments of the invention described below. Hereinafter, the invention is described in more detail by way of preferred embodiments with reference to the accompanying figures.

DETAILED DESCRIPTION OF EXEMPLARY EMBODIMENTS OF THE PRESENT INVENTION

Figure 1:
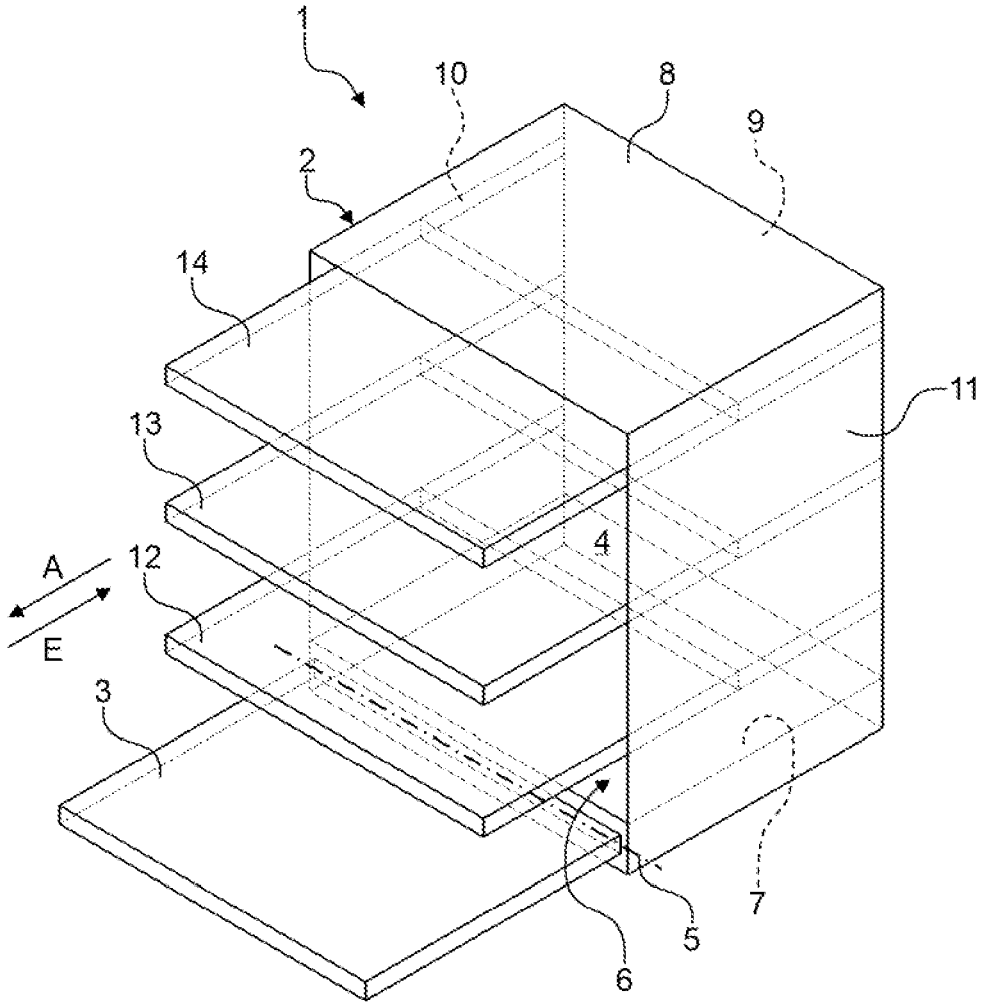
FIG. 1 shows a schematic perspective view of an embodiment of a household dishwasher.

Elements which are the same or functionally the same are provided with the same reference characters in the figures, unless indicated otherwise.

FIG. 1 shows a schematic perspective view of an embodiment of a household dishwasher 1. The household dishwasher 1 comprises a dishwasher cavity 2 which is closable by a door 3, in particular in a water-tight manner.

To this end, a sealing apparatus may be provided between the door 3 and the dishwasher cavity 2. The dishwasher cavity 2 is preferably cuboidal. The dishwasher cavity 2 may be arranged in a housing of the household dishwasher 1. The dishwasher cavity 2 and the door 3 may form a washing chamber 4 for washing washware.

The door 3 is shown in FIG. 1 in the open position thereof. The door 3 may be closed or opened by pivoting about a pivot axis 5 provided at a lower end of the door 3. A loading opening 6 of the dishwasher cavity 2 may be closed or opened by means of the door 3. The dishwasher cavity has a bottom 7, a ceiling 8 arranged opposite the bottom 7, a rear wall 9 arranged opposite the closed door 3 and two side walls 10, 11 arranged opposite one another.

The bottom 7, the ceiling 8, the rear wall 9 and the side walls 10, 11 may be produced, for example, from a stainless steel sheet. Alternatively, for example, the bottom 7 may be produced from a plastics material. The household dishwasher 1 also has at least one washware receptacle 12 to 14. Preferably a plurality of washware receptacles 12 to 14, for example three thereof, may be provided, wherein the washware receptacle 12 may be a lower washware receptacle or a bottom rack, the washware receptacle 13 may be an upper washware receptacle or a top rack and the washware receptacle 14 may be a cutlery drawer.

As FIG. 1 also shows, the washware receptacles 12 to 14 are arranged one above the other in the dishwasher cavity 2. Each washware receptacle 12 to 14 is optionally displaceable into the dishwasher cavity or out of said dishwasher cavity. In particular, each washware receptacle 12 to 14 is able to be pushed or retracted into the dishwasher cavity 2 in a push-in direction E (arrow) and is able to be pulled or extended out of the dishwasher cavity 2 counter to the push-in direction E (arrow) in a pull-out direction A (arrow).

Figure 2:
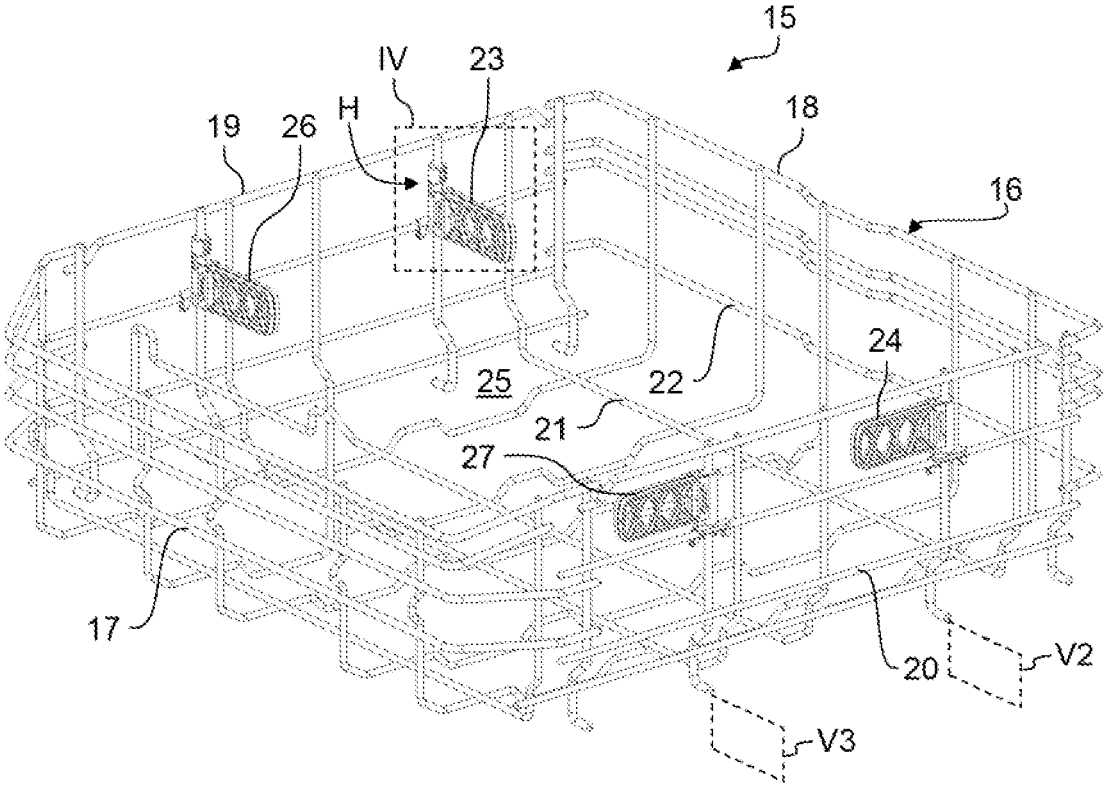
FIG. 2 shows a schematic perspective view of an embodiment of an arrangement for the household dishwasher according to FIG. 1.

FIG. 2 shows a schematic perspective view of an arrangement 15. The arrangement 15, for example, may be part of the household dishwasher 1 of FIG. 1. The arrangement comprises a dish rack 16. The dish rack 16 may be configured, for example, as the bottom rack 12 of FIG. 1. The dish rack 16 comprises a front wall 17, a rear wall 18 arranged opposite the front wall 17, a side wall 19, a side wall 20 arranged opposite the side wall 19, and a rack bottom 21. The dish rack 16 consists, for example, of bent wires 22.

The arrangement 15 further comprises a holder 23 (in the present case also denoted as the first holder) which is pivotably fastened to the side wall 19. The arrangement 15 also comprises a holder 24 (in the present case also denoted as the second holder) which is pivotably fastened to the side wall 20. The holder 23 is in the holding position H and protrudes into a receiving volume 25 of the dish rack 16. A holder 26 (in the present case also denoted as the third holder) is also pivotably fastened to the side wall 19. A holder 27 (in the present case also denoted as the fourth holder) is also pivotably fastened to the side wall 20. The holder 23 and the holder 24 are arranged directly opposing one another. In the holding position H of the holders 23, 24, said holders are located in a vertical plane V2. The holder 26 and the holder 27 are arranged directly opposing one another. In the holding position H of the holders 26, 27, said holders are located in a vertical plane V3 which runs parallel with and spaced apart from the vertical plane V2.

Figure 3:
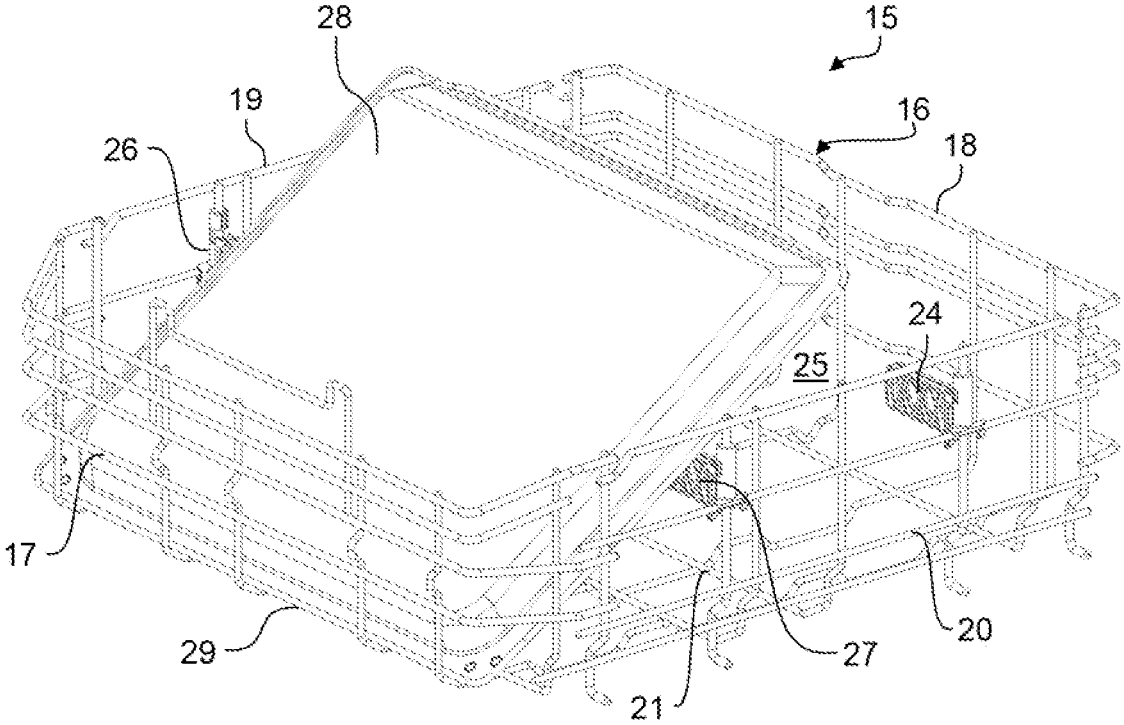
FIG. 3 shows a schematic perspective view of an embodiment of the arrangement with a baking sheet.

FIG. 3 shows a schematic perspective view of the arrangement 15 with a baking sheet 28. The baking sheet 28 is located in the receiving volume 25 of the dish rack 16. Moreover, the baking sheet 28 is supported on the holders 26, 27 which are located in the holding position H. An edge 29 of the baking sheet 28 is located on the front wall side on the rack bottom 21. Since the holders 26, 27 are provided above the rack bottom 21, the baking sheet 28 is held in an inclined position relative to the rack bottom 21. Advantageously, the receiving volume 25 may be better utilized thereby. In particular, a further baking sheet (not shown) or the same baking sheet 28 may be held, in particular, at a different inclination to the rack bottom 21 by means of the holders 23, 24 in the dish rack 16. Preferably, the holders 23, 24, 26, 27 are configured as baking sheet holders.

Figure 4:
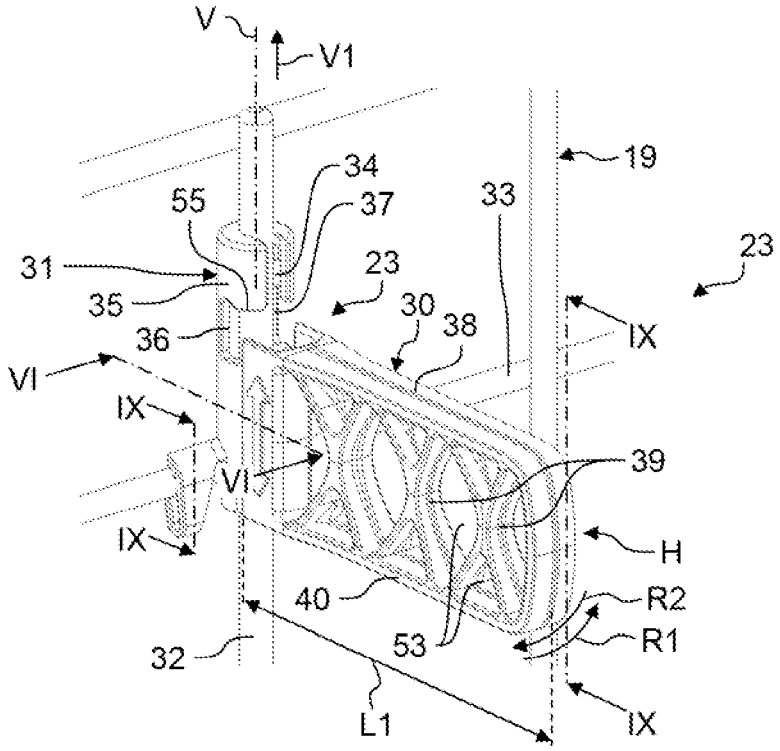
FIG. 4 shows a detail IV of FIG. 2.

FIG. 4 shows a detail IV of FIG. 2. The holder 23 comprises a holding element 30 and a fastening element 31. For example, the holding element 30 is positively connected to the fastening element 31. The holder 23 is fastened by means of the fastening element 31 to the side wall 19. The holding element 30 is provided so as to be pivotable relative to the side wall 19 about a vertical axis V in a pivoting direction R1 (in the present case also denoted as the first pivoting direction) and in a pivoting direction R2 (in the present case also denoted as the second pivoting direction). The holding element 30 and the fastening element 31 are designed such that a pivoting in the pivoting directions R1, R2 may be blocked when the holding element 30 is located in the holding position H (as shown in FIG. 4). In the holding position H the holding element 30 is pivoted away from the side wall 19.

Preferably, the holding element 30 protrudes perpendicularly away from the side wall 19 when said holding element is located in the holding position H. The fastening element 31 is preferably rigidly connected to the side wall 19 and thus provided immovably on the side wall 19. Moreover, the holding element 30 is pivotably fastened to the fastening element 31. The fastening element 31 is connected to a vertical wire 32 of the side wall 19 and to a horizontal wire 33 of the side wall 19.

The blocking of the pivoting in the holding position H may be carried out, for example, by means of a positive connection between the fastening element 31 and the holding element 30. In the holding position H, the holding element 30 is able to be moved upwardly in the vertical direction V1 relative to the fastening element 31 in order to release the positive connection. The fastening element 31 comprises a stop 34 which defines the movement of the holding element 30 upwardly in the vertical direction V1. If the holding element 30 is moved upwardly in the vertical direction V1, such that the positive connection is released, then the pivoting is released in the pivoting directions R1, R2.

The fastening element 31 comprises an open sleeve portion 35. The sleeve portion 35 comprises a recess 36 which permits the pivoting in the pivoting direction R2. The sleeve portion 35 comprises a further recess 37 which is preferably provided mirror-symmetrically to the recess 26 and which permits the pivoting in the pivoting direction R1. The holding portion 30 comprises a support portion 38 which comprises a frame 40, X-shaped struts 39 being arranged therein. Openings 53 are configured between the X-shaped struts 39. Thus, for example, a stable support portion 38 which, in particular, does not influence the washing cycle may be formed. The support portion 38 is preferably tab-shaped and has a length L1 of between 2 and 15 cm, 3 and 10 cm or 4 and 8 cm.

Figure 5:
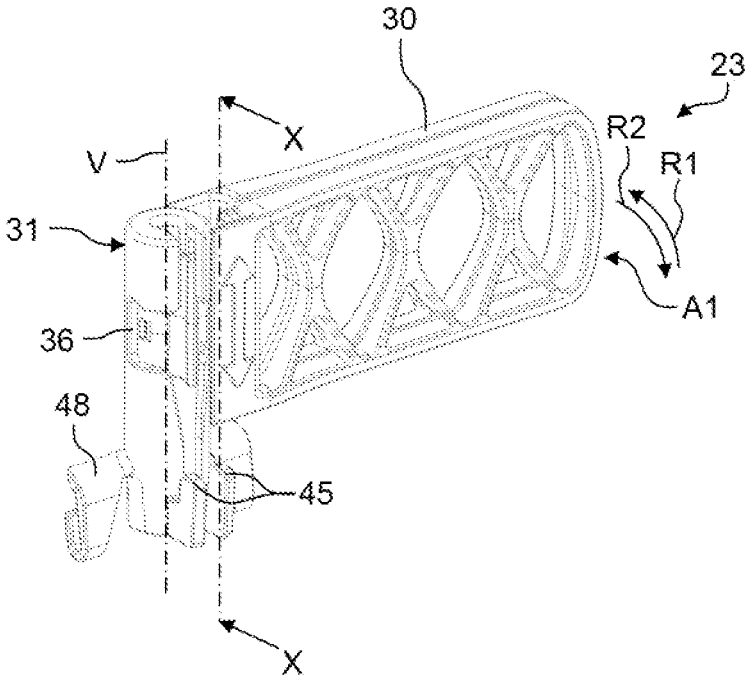
FIG. 5 shows a schematic perspective view of a holder of the arrangement according to FIG. 2 in the folded-in position.

FIG. 5 shows a schematic perspective view of the holder 23. In contrast to FIG. 4 the holding element 30 is located in a folded-in position A1 (in the present case also denoted as the first folded-in position). In this case, the holding element 30 has been rotated by 90° in the pivoting direction R1 relative to the fastening element 31. The pivot axis is formed by the vertical axis V. This axis, in particular, is at the same time also an axis of rotational symmetry of the vertical wire 32. In the folded-in position μl the holding element 30 preferably forms a positive connection with the fastening element 31 so that an inadvertent pivoting is prevented.

Moreover, in a further folded-in position (in the present case also denoted as the second folded-in position) (not shown) in which the holding element 30 rotated by 180° relative to the folded-in position A1 bears against the side wall 19, for example, the holding element 30 may be designed to block pivoting in the pivoting directions R1, R2.

Figure 6:
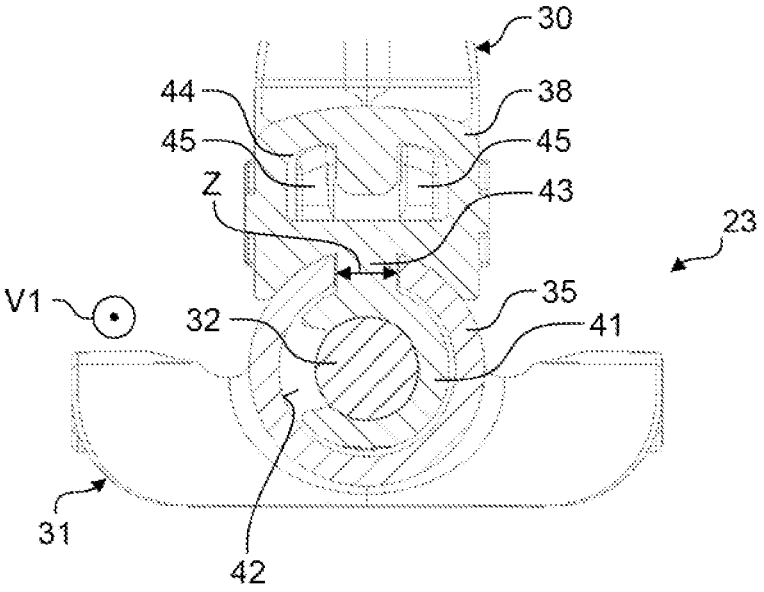
FIG. 6 shows a section VI-VI of FIG. 4.

FIG. 6 shows a section VI-VI of FIG. 4. The sleeve portion 35 has an open annular shape in cross section. The sleeve portion 35 comprises a slot Z running in the vertical direction V1. The sleeve portion 35 is preferably able to be resiliently bent open at this slot, such that the sleeve portion 35 may be pushed onto the vertical wire 32. The holding element 30 engages in the sleeve portion. Moreover, the holding element 30 comprises a fastening means 41 which is pivotably fastenable to the vertical wire 32 and which is designed to enclose the vertical wire 32.

Preferably, the fastening means 41 has an open annular shape or C-shape in cross section. In particular, the fastening means 41 is configured as an open annular portion which is snapped or latched onto the vertical wire 32. This annular portion is preferably able to be resiliently bent open in order to insert the vertical wire 32 into the open annular portion. The fastening means 41 is guided in the vertical direction V1 by means of an inner face 42 of the sleeve portion 35 which functions as a receiver. The fastening means 41 is connected by means of the connecting portion 43 to the support portion 38. The connecting portion 43 forms a cross-sectional tapering between the fastening means 41 and the support portion 38. The support portion 38 is adapted on the sleeve portion side to the sleeve portion 38 and has corresponding rounded portions. Moreover, the support portion 38 has a U-shaped recess 44, two lugs 45 of the fastening element 31 engaging therein. The recess 44 is adapted to the lugs 45. This engagement brings about a positive connection between the holding element 30 and the fastening element 31 in the holding position H. The fastening means 41 is provided directly between the vertical wire 32 and the sleeve portion 35 and is guided in a linear manner thereby in the vertical direction V1.

If the holding element 30 is moved upwardly in the vertical direction V1, then the recess 44 is moved away from the lugs 45 such that a positive connection is no longer present between the holding element 30 and the fastening element 31 and a pivoting movement of the holding element 30 is released. The lugs 45 are configured as projections which extend upwardly in the vertical direction V1. So that a pivoting into the folded-in position A1 is possible, in particular, the connecting portion 43 has to be level with the recesses 36, 37 (see FIG. 4).

Figure 7:
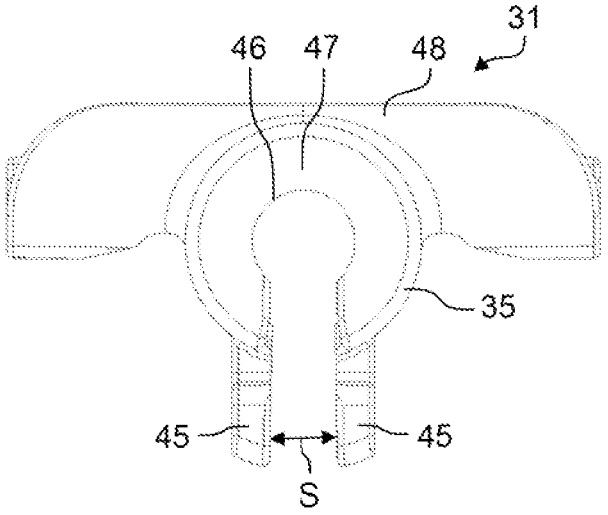
FIG. 7 shows a plan view of a fastening element of the holder according to FIG. 4.

FIG. 7 shows a plan view of the fastening element 31. The fastening element 31 is preferably configured to be substantially T-shaped (viewed from above). A gap S between the lugs 45 may be resiliently widened so that the vertical wire 32 may be inserted into the sleeve portion 35. A receiver 46 for the vertical wire 32 is provided on an upper face 47 of the fastening element 31. The receiver 46 is adapted to an outer contour of the vertical wire 32 and forms therewith a positive connection. The fastening element 31 further comprises a fastening part 48 which is fastenable to the horizontal wire 33 (see FIG. 11). In this case, the fastening part 48 is configured below the sleeve portion 35.

Figure 8:
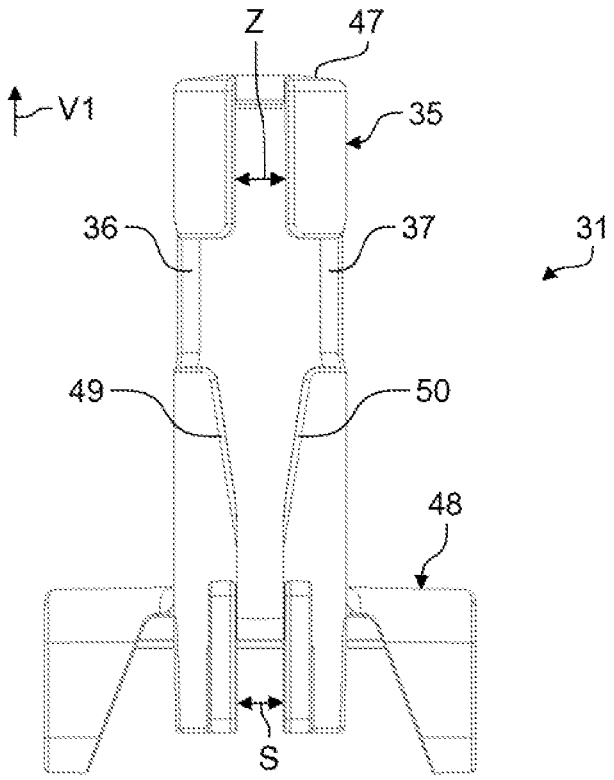
FIG. 8 shows a front view of the fastening element.

FIG. 8 shows the fastening element 31 in a front view. The slot Z runs continuously through the sleeve portion 35 in the vertical direction V1. The recesses 36, 37 are provided adjacent to the slot Z and connected together by means of the slot Z. The slot Z is uniform above the recesses 36, 37. Below the recesses 36, 37 the slot Z is widened and tapers downwardly in a V-shaped manner to the above slot width. Thus insertion bevels 49, 50 are formed below the recesses 36, 37. With a movement of the connecting portion 43 (see FIG. 6) downwardly the insertion bevels 49, 50 function as a centering means so that the recess 44 (see FIG. 6) may be guided over the lugs 45 without great dexterity being required.

Figure 9:
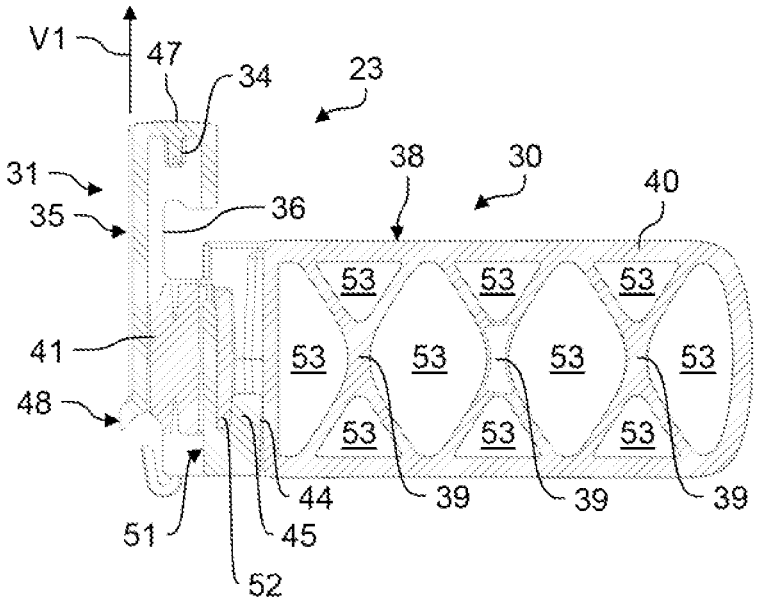
FIG. 9 shows a section IX-IX of FIG. 4.

FIG. 9 shows a section IX-IX of FIG. 4, wherein the vertical wire 32 is concealed. The fastening element 31 comprises a hook element 51 on which the lug 45 is formed. The recess 44 is configured as a through-opening which extends in the vertical direction V1 in the support portion 38. A wall 52 of the support portion 38 is hooked inside the hook element 51. The stop 43 is configured inside the sleeve portion 35. Preferably, the stop 43 protrudes downwardly away from the upper face 47.

Figure 10:
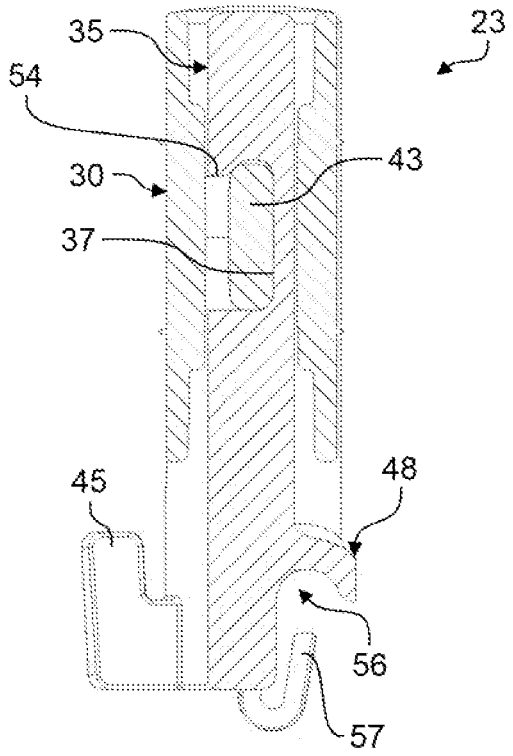
FIG. 10 shows a section X-X of FIG. 5.

FIG. 10 shows a section X-X from FIG. 5. In this case, the connecting portion 43 is arranged inside the recess 37. In order to reach the recess 37, the connecting portion 43 had to push away a lug 54 of the sleeve portion 35 upwardly. To this end, when the holding element 30 is pivoted a certain force has to be applied so that the sleeve portion 35 is resiliently deformed and the lug 54 is pushed away upwardly. Once the connecting portion 43 has entered the recess 37 fully, the sleeve portion 35 is deformed back so that the lug 54 engages behind the connecting portion 43 and snaps thereon.

In order to move the holding element 30 out of the folded-in position μl back into the holding position H, a certain force has to be overcome in order to push away the lug 54 again. Since the fastening element 31 comprises two recesses 36, 37 and two lugs 54, 55, therefore, two latching positions of the holding element 30 are possible (i.e. folded-in positions). The fastening part 48 comprises a receiver 56 for the horizontal wire 33. For example, a latching lug 57 may be provided in order to form a latching connection with the horizontal wire 33. Preferably, the fastening part 48 comprises two latching lugs 57 arranged adjacent to one another.

Figure 11:
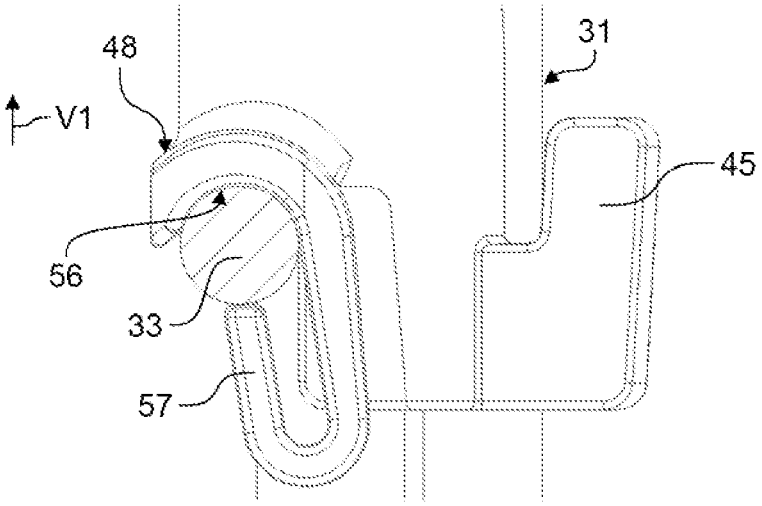
FIG. 11 shows a section XI-XI of FIG. 4.

FIG. 11 shows a section XI-XI from FIG. 4. In this case, the horizontal wire 33 is received in the receiver 56. The latching lug 57 prevents the fastening element 31 from being released from the horizontal wire 33. The fastening element 31 is secured in the vertical direction V1 relative to the side wall 19 by means of the fastening part 48 and the horizontal wire 33. The fastening part 48 or the receiver 56 faces away from the lugs 45.

Whilst the present invention has been described with reference to exemplary embodiments, it may be modified in many different ways. It goes without saying that the holders 23, 24, 26, 27 may be configured identically.

The invention claimed is:

1. A holder for holding washware in a dish rack of a household dishwasher, said holder comprising:

a holding element fastenable on a side wall of a dish rack for pivoting about a vertical axis in a first pivoting direction and a second pivoting direction in opposition to the first pivoting direction, the holding element comprising a recess; and a fastening element rigidly fastenable to the side wall of the dish rack and comprising a lug, the holding element being pivotably fastened to the fastening element, the fastening element being configured to block the holding element from pivoting in the first pivoting direction and in the second pivoting direction when the holding element assumes a holding position in which washware is held and the holding element is pivoted away from the side wall in the holding position by pushing the recess of the holding element onto the lug.

2. The holder of claim 1, wherein the holding element is blocked from pivoting in the holding position by a positive connection between the fastening element and the holding element.

3. The holder of claim 2, wherein in the holding position the holding element is movable upwardly in a vertical direction relative to the fastening element to release the positive connection.

4. The holder of claim 1, wherein the fastening element comprises a sleeve portion for engagement therein of at least one region of the holding element and for guidance of the holding element.

5. The holder of claim 1, wherein the holding element comprises a fastening means which is pivotably fastenable to a vertical wire of the dish rack and which is designed to enclose the vertical wire.

6. The holder of claim 1, wherein the fastening element comprises a fastening part which is fastenable to a horizontal wire of the side wall.

7. The holder of claim 1, wherein, in a first folded-in position in which the holding element bears against the side wall, the holding element is designed to block pivoting in the first pivoting direction and in the second pivoting direction.

8. The holder of claim 7, wherein in the first folded-in position the holding element forms a positive connection with the fastening element.

9. The holder of claim 7, wherein, in a second folded-in position in which the holding element is rotated by 180° to the first folded-in position and bears against the side wall, the holding element is designed to block pivoting in the first pivoting direction and in the second pivoting direction.

10. An arrangement for a household dishwasher, said arrangement comprising:

a dish rack; and a holder comprising:

a holding element fastenable on a side wall of the dish rack for pivoting about a vertical axis in a first pivoting direction and a second pivoting direction in opposition to the first pivoting direction, the holding element comprising a recess; and a fastening element rigidly fastenable to the side wall of the dish rack and comprising a lug, the holding element being pivotably fastened to the fastening element, the fastening element being configured to block the holding element from pivoting in the first pivoting direction and in the second pivoting direction when the holding element assumes a holding position in which washware is held and the holding element is pivoted away from the side wall in the holding position by pushing the recess of the holding element onto the lug.

11. The arrangement of claim 10, wherein the dish rack comprises a first side wall and an opposing second side wall, said holder including a first holder pivotably fastened to the first side wall and a second holder pivotably fastened to the second side wall, said first and second holders being designed to hold a baking sheet in the holding position.

12. The arrangement of claim 11, wherein the holder includes a third holder pivotably fastened to the first side wall and a fourth holder pivotably fastened to the second side wall, said third and fourth holders being designed to hold the baking sheet in the holding position.

13. A household dishwasher, comprising:

a holder, said holder comprising:

a holding element fastenable on a side wall of a dish rack for pivoting about a vertical axis in a first pivoting direction and a second pivoting direction in opposition to the first pivoting direction, the holding element comprising a recess; and a fastening element rigidly fastenable to the side wall of the dish rack and comprising a lug, the holding element being pivotably fastened to the fastening element, the fastening element being configured to block the holding element from pivoting in the first pivoting direction and in the second pivoting direction when the holding element assumes a holding position in which washware is held and the holding element is pivoted away from the side wall in the holding position b pushing the recess of the holding element onto the lug.

14. A household dishwasher, comprising an arrangement as set set forth in claim 11.

* * * * *